US005394870A

United States Patent [19]

Johansson

[11] Patent Number: 5,394,870

[45] Date of Patent: Mar. 7, 1995

[54] RESPIRATOR BLOWER UNIT HOUSING WITH POMMEL-LIKE STRAP SUPPORT MEMBER COMPRISING LOWER EXTERIOR SUPPORT SURFACE

[75] Inventor: Ronald C. Johansson, Stillwater Township, Washington County, Minn.

[73] Assignee: Minnesota Mining and Manufacturing Company, St. Paul, Minn.

[21] Appl. No.: 115,694

[22] Filed: Sep. 3, 1993

[51] Int. Cl.[6] ..... A62B 7/10; A62B 9/04; A62B 19/00; A62B 23/02

[52] U.S. Cl. ..... 128/205.22; 128/205.29; 128/206.12; 128/201.25

[58] Field of Search ..... 224/185, 192, 197, 201, 224/202, 208, 270; 128/200.24, 201.22–201.26, 202.27, 204.18, 204.26, 205.12, 205.22, 205.29, 206.12

[56] References Cited

U.S. PATENT DOCUMENTS

| | | | |
|---|---|---|---|
| 139,885 | 6/1873 | Elliot | 224/208 |
| 1,469,285 | 10/1923 | Thompson | 224/270 |
| 1,470,334 | 1/1923 | Stensgaard et al. | 224/208 |
| 1,583,528 | 5/1926 | Clements . | |
| 2,564,318 | 8/1951 | Wick | 224/202 |
| 2,578,237 | 12/1951 | Geistweit | 224/270 |
| 3,215,322 | 4/1964 | Boyer et al. | 224/26 |
| 3,348,746 | 10/1967 | Stumpf | 224/270 |
| 3,493,703 | 2/1970 | Finan | 128/204.26 |
| 4,377,163 | 3/1983 | Feathers | 128/205.22 |
| 4,419,110 | 12/1983 | Ansite et al. | 55/356 |
| 4,461,055 | 7/1984 | Zerrer et al. | 15/344 |
| 4,522,639 | 6/1985 | Ansite et al. | 55/314 |
| 4,570,286 | 2/1986 | Ross | 15/327 |
| 4,590,951 | 5/1986 | O'Connor | 128/204.23 |
| 4,685,456 | 8/1987 | Smart | 128/204.18 |
| 5,002,049 | 3/1991 | Knoll | 128/204.18 |
| 5,009,225 | 4/1991 | Vrabel | 128/200.24 |
| 5,022,900 | 6/1991 | Bar-Yona et al. | 55/316 |
| 5,167,354 | 12/1992 | Cohanfard | 224/148 |

OTHER PUBLICATIONS

Shigematsu Works Co. Ltd., Tokyo, Japan, Product Brochure, "Industrial Safety Equipment," Jun. 1993, p. 7.

Shigematsu Works Co. Ltd., Tokyo, Japan, Respiration Product brochure, Nov. 1985, p. 57 (translation provided).

*Primary Examiner*—Kimberly L. Asher

*Attorney, Agent, or Firm*—Gary L. Griswold; Walter N. Kirn; Carole Truesdale

[57] ABSTRACT

A housing for a powered air purifying respirator blower unit is provided. The housing comprises first and second major faces which are spaced from each other, and a top wall, side walls, and bottom wall connecting the major faces along their peripheries. The first and second major faces and the top wall, side walls, and bottom wall enclose therebetween an air chamber. An air inlet and an air outlet are in communication with the air chamber, the air outlet being proximate the top wall. A support base is proximate the air outlet and connected to the first major face. A pommel-like strap support member protrudes from the support base in a direction away from the second major face and comprises a lower exterior support surface which is adapted to support a carrying strap thereon such that the carrying strap can extend away from the housing at a variety of angles. The air outlet opens through the top of the pommel-like member. The housing includes a means for retaining a carrying strap on the pommel-like member. Also provided is a powered air purifying respirator comprising such a housing.

16 Claims, 3 Drawing Sheets

RESPIRATOR BLOWER UNIT HOUSING WITH POMMEL-LIKE STRAP SUPPORT MEMBER COMPRISING LOWER EXTERIOR SUPPORT SURFACE

FIELD OF THE INVENTION

The present invention relates to respirator blower units for powered air purifying respirators, and in particular, relates to the way in which such blower units are supported adjacent a user's body.

BACKGROUND

Powered air purifying respirators utilize a motor-driven blower unit to provide a forced flow of filtered air to the face of a wearer to ensure (in normal operation) that the wearer has an adequate supply of clean breathable air in a contaminated environment.

A major benefit to the wearer of a powered air purifying respirator, in comparison to a conventional non-powered respirator in which a filter is attached directly to the inlet of the facepiece, is that the wearer's lungs are relieved of the strain otherwise caused by inhalation against the resistance of the filter.

The motor-driven blower unit of a powered air purifying respirator can be carried on or near the waist of a wearer by a shoulder strap, a strap extending around the waist of the wearer, or both. Typically, a flexible hose is used to transport the air exiting from the blower to a facepiece worn about the face of the wearer.

SUMMARY OF INVENTION

The present invention provides a housing for a powered air purifying respirator blower unit. The blower unit can be carried with a carrying strap in such a way that the blower unit conforms closely to the body of the user irrespective of the location at which the blower unit is carried around the body of the user. The invention does not require that brackets or other attachment devices be used to attach a carrying strap to the blower unit, and thus, the blower unit can generally be more easily cleaned than prior art blower units.

In brief summary, the invention relates to a housing for a powered air purifying respirator blower unit, comprising:

a) first and second major faces which are spaced from each other, and a top wall, side walls, and bottom wall connecting the major faces along their peripheries, the first and second major faces and the top wall, side walls, and bottom wall enclosing therebetween an air chamber;

b) an air inlet and an air outlet which are in communication with the air chamber, the air outlet being proximate the top wall;

c) a support base which is proximate the air outlet and connected to the first major face;

d) a pommel-like strap support member protruding from the support base in a direction away from the second major face, the pommel-like member comprising a lower exterior support surface which is adapted to support a carrying strap thereon, wherein the air outlet opens through the top of the pommel-like member; and e) means for retaining a carrying strap on the pommel-like member.

In another of its aspects, the invention relates to a powered air purifying respirator comprising:

a) a motor-driven blower disposed in the housing described above;

b) a facepiece defining a space adapted to cover the mouth and nose of a wearer and having an inlet and outlet for air;

c) means for filtering one or more unwanted components from external air drawn into the housing by operation of the blower; and d) means for transporting air from the air outlet of the housing to the inlet of the facepiece.

BRIEF DESCRIPTION OF DRAWING

The invention will be further explained with reference to the drawing, wherein.

These figures, which are idealized, are not to scale and are intended to be merely illustrative and nonlimiting.

DETAILED DESCRIPTION OF ILLUSTRATIVE EMBODIMENTS

Figure 1:
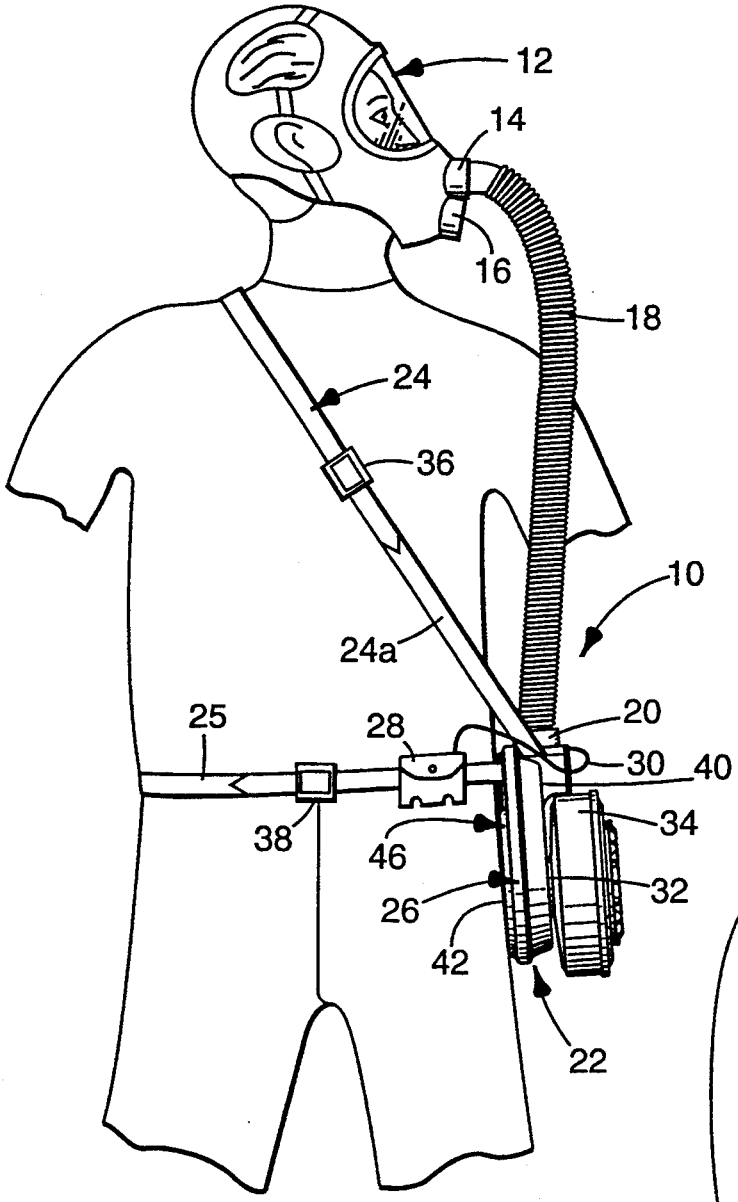
FIG. 1 is a front schematic view of a person utilizing a powered air purifying respirator according to the invention.

Referring to FIG. 1, a powered air purifying respirator 10 comprises a facepiece 12 which defines a space adapted to cover the mouth and nose of the wearer and having an inlet 14 for receiving air and an outlet 16 for exhausting air. The facepiece 12 shown comprises a full face mask covering the eyes, nose, and mouth of the wearer and is held on the wearer's head by a retaining means which extends around the back of the wearer's head and is peripherally sealed to the head of the wearer. The facepiece can, however, be a partial face mask, or may be in the form of a helmet or hood if adequately sealed to the wearer's head or neck. A suitable facepiece comprising one-way valves in the facepiece air inlet and air outlet is disclosed in U.S. Pat. No. 4,590,951 (O'Connor) which is incorporated herein by reference.

A flexible hose 18 is used as a means for transporting air from an air outlet 20 of a blower unit 22 to the inlet 14 of the facepiece 12. As shown, the blower unit 22 is adapted to be supported by a carrying strap 24 on the hip of the wearer but may alternatively be worn on the wearer's rump (see FIG. 2), or may be supported anywhere else around the body of the wearer, typically around the wearer's waist. Although not required, a belt 25 can be used as an additional means for supporting the blower unit 22 by passing the belt through a belt loop 35 (see FIG. 4) provided on the housing 26. Buckles 36, 38 can be used to adjust the effective length of the carrying strap 24 and belt 25, respectively.

The blower unit 22 comprises a housing 26 in which a blower (not shown) comprising a fan, e.g., a centrifugal fan, and a d.c. motor driving the fan are housed. A battery pack 28 containing one or more batteries (not shown) supplies direct current to the motor of the blower unit 22 through an electrical connection 30. Although the battery pack 28 is shown mounted on the belt 25, the battery pack 28 can instead be mounted in or on the housing 26. The housing 26 comprises an air inlet 32 which is preferably threaded to receive a filter 34 which acts as a means for filtering one or more unwanted components from external air drawn into the air inlet 32 of the housing 26 by operation of the blower. The filter 34 can comprise a particulate filter material and/or a gas and/or vapor filter material.

Figure 3:
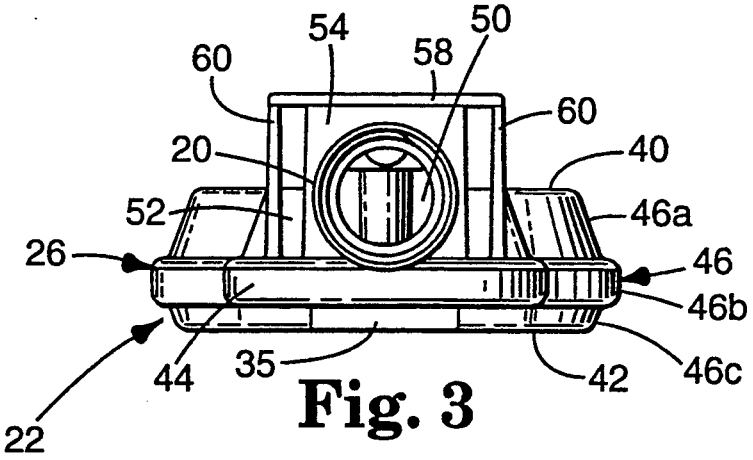
FIG. 3 is a top view of the blower unit housing.

Turning now to FIG. 3, the blower unit housing 26 is shown in more detail. The housing 26 comprises first and second major faces 40, 42, which are spaced from each other, and a top wall 44, side walls 46, and bottom wall 48 (see FIG. 4) connecting the first and second major faces along their peripheries. Each of the walls in the drawing typically comprises three distinct, continuous surfaces designated by the letters a, b, c, which continuous surfaces are typically integrally connected to each other. For example, the side wall 46 typically comprises three distinct, continuous surfaces 46*a*, 46*b*, 46*c*, which are integrally connected to each other.

Figure 4:
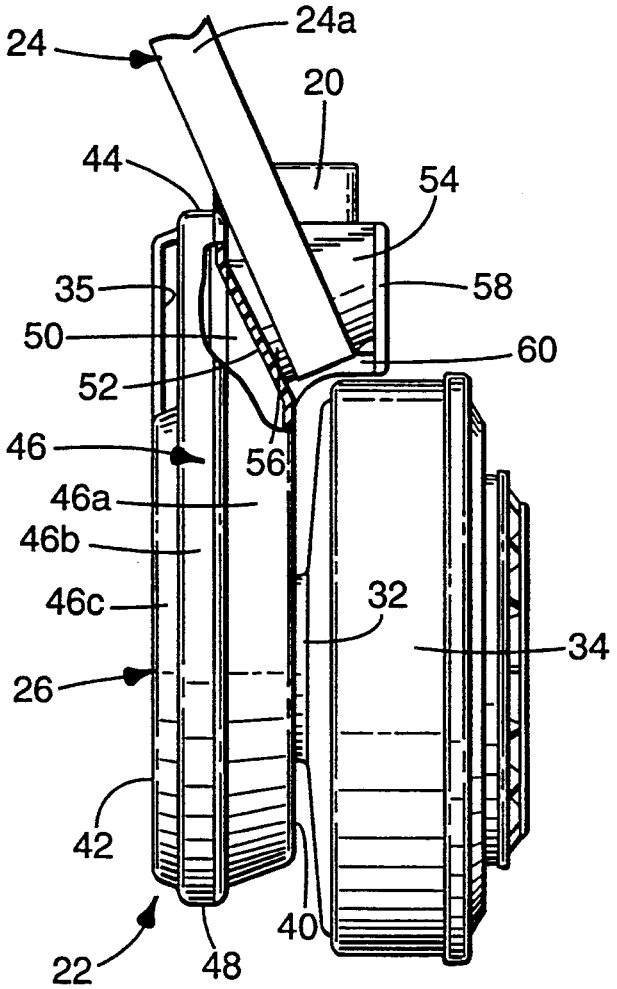
FIG. 4 is a side view of the blower unit housing, wherein one of the side retaining walls of the housing has been removed and part of the housing is shown in cross section, and showing an attached filter means and one possible orientation of a carrying strap relative to the housing.

The first and second major faces and the top wall, side walls, and bottom wall enclose therebetween an air chamber 50. Referring to FIG. 4, the air inlet 32 and the air outlet 20 are in communication with the air chamber 50, and the air outlet is proximate the top wall 44. A support base 52 is proximate the air outlet and connected to the first major face 40. As shown, the support base is typically integral with the first major face and is inclined such that it slopes toward the second major face 42 and the top wall 44.

A key component of the housing is a pommel-like strap support member 54 which protrudes from the support base 52 in a direction away from the second major face 42. As shown, the pommel-like member 54 comprises a lower exterior support surface 56 which is adapted to support the carrying strap 24 thereon and preferably comprises a curved portion. Typically, the pommel-like member 54 slidably supports the carrying strap 24 thereon. As shown, the air outlet 20 opens through the top of the pommel-like member 54 and is adapted to direct a stream of air out of the housing in an upward direction.

Turning back briefly to FIG. 3, the air outlet 20 of the housing has a width which is defined herein to be the maximum horizontal distance across the air outlet 20, with the horizontal distance being defined as lying in any plane which is parallel to the plane in which the second major face 42 lies. Referring to FIG. 4, the curved portion of the lower exterior support surface 56 of the pommel-like member 54 preferably has a radius of curvature which is larger than half the width of the air outlet 20 such that the pommel-like member is adapted to support the carrying strap thereon such that portions 24*a*, 24*b* thereof (see FIG. 5) can extend upwardly beyond contact with the pommel-like member at positions located outwardly of the air outlet. This concept may be more readily visualized with reference to FIG. 3 where it can be seen that the portions of a carrying strap (not shown in FIG. 3) exiting upwardly from the pommel-like member 54 would extend upwardly beyond contact with the pommel-like member at positions located outwardly of the air outlet 20. This configuration of the housing permits any flexible hose connected to the air outlet of the housing to extend upwardly away from the housing to the inlet of the facepiece without interfering with the carrying strap.

Referring again to FIG. 4, the central axis about which the radius of curvature of the curved portion of the lower exterior support surface 56 is defined preferably extends perpendicularly away from the support base 52 and away from the second major face 42 at an angle of between about 105 and about 120 degrees relative to the plane in which the first major face 40 lies. Most preferably, this angle is about 110 degrees.

Turning again to FIG. 3, the housing comprises a means for retaining the carrying strap on the pommel-like member 54. This retaining means typically comprises a front retaining wall 58 attached to the outermost end of the pommel-like member and side retaining walls 60 spaced outwardly from the pommel-like member and extending from the support base 52 toward the front retaining wall 58. Although the side retaining walls 60 are shown as being immediately adjacent the front retaining wall 58, the side retaining walls 60 need not extend all the way to the front retaining wall 58 so that a gap (not shown) is provided between the side retaining walls 60 and the front retaining wall 58. A one-piece carrying strap could be easily inserted through such a gap and then suitably positioned adjacent the pommel-like member 54. Alternatively, it is contemplated that the side retaining walls 60 can depend from the front retaining wall 58 toward the support base 52, and a gap can analogously be provided, if desired, between each side retaining wall 60 and the support base 52.

The housing 26 is preferably made of an injection moldable thermoplastic resin, most preferably an ABS (acrylonitrile-butadiene-styrene) resin.

In operation, the pommel-like member 54 of the housing 26 permits the blower unit to be supported by the carrying strap 24 in such a way that the blower unit conforms closely to the body of the user irrespective of the location at which the blower unit is carried around the body of the user. Thus, the carrying strap can extend away from the housing at a variety of angles depending upon the location at which the housing is carried on the body, and the blower unit will lie comfortably adjacent the user's body.

Figure 2:
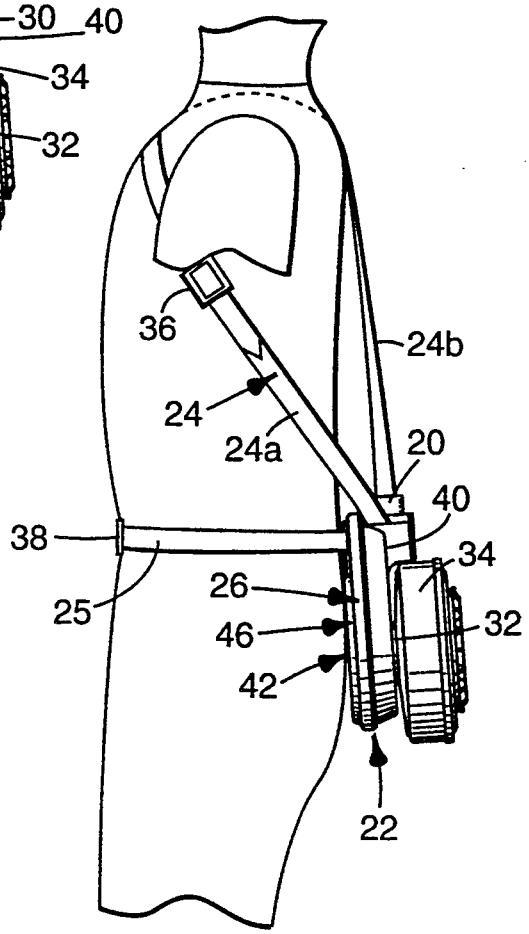
FIG. 2 is similar to FIG. 1 but is a side view and illustrates a second position in which the blower unit of the respirator can be carried on the wearer's body.
Figure 5:
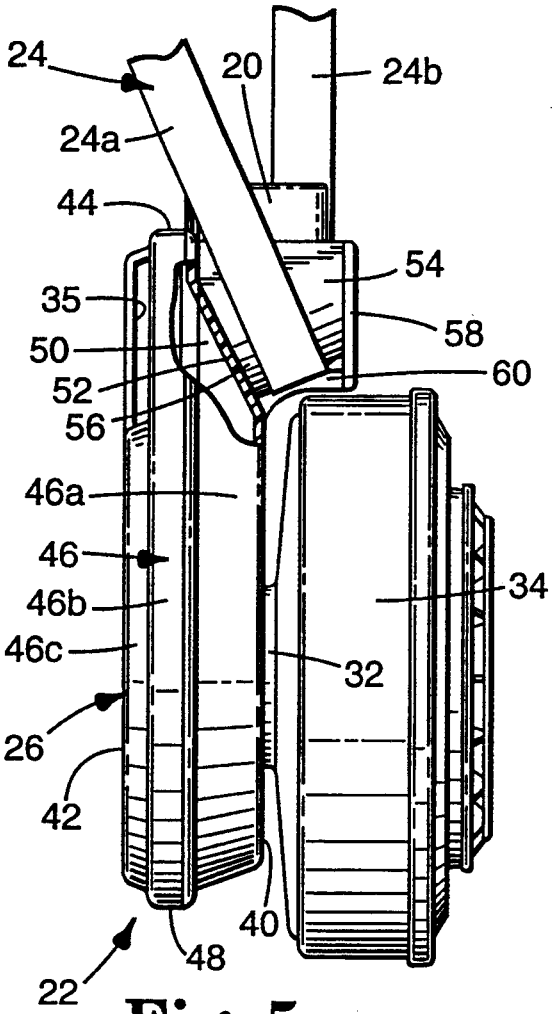
FIG. 5 is similar to FIG. 4 but shows a second possible orientation of a carrying strap relative to the housing.

In particular, as shown in FIGS. 2 and 5, when the blower unit is positioned adjacent the rump of the user, the portion 24*a* of the carrying strap 24 typically extends away from the housing 26 at an angle of from about 15 to about 30 degrees, most typically about 30 degrees, from the vertical. It should be noted that typically, the first and second major faces 40, 42 are parallel and adapted to extend along the height of the user in a generally vertical direction irrespective of the position at which the housing is worn on the user's body. Portion 24*b* of the carrying strap will typically extend away from the housing 26 at an angle of less than about 10 degrees, most typically about 5 degrees, from the vertical.

Figure 6:
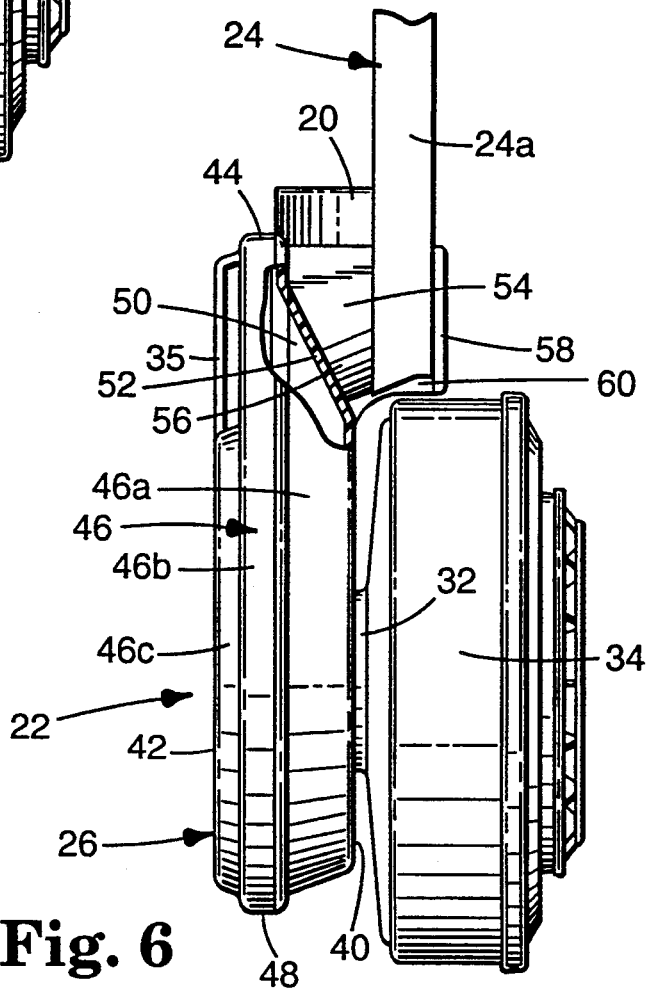
FIG. 6 is similar to FIG. 4 but shows a third possible orientation of a carrying strap relative to the housing.

As shown in FIGS. 1 and 4, when the blower unit is positioned adjacent the hip of the user, both portions 24*a*, 24*b* of the carrying strap 24 typically extend away from the housing 26 at an angle of from about 15 to about 30 degrees, most typically about 20 degrees, from the vertical. Lastly, referring to FIG. 6, if the blower unit is positioned adjacent the hip of the user but the carrying strap is draped over the nearest shoulder of the user, each portion 24*a*, 24*b* of the carrying strap 24 will typically extend away from the housing 26 at an angle of less than about 10 degrees, most typically about 5 degrees, from the vertical, although an angle of about 0 degrees as shown in the drawing is also possible.

As is apparent from the above description, the configuration of the pommel-like member of the housing permits a one-piece carrying strap to be used in supporting the housing comfortably along the user's body in close conformance thereto irrespective of the location around the body of the user at which the housing is carried. The carrying strap can extend upwardly away from the housing at a variety of angles without buckling or folding over itself.

The housing can easily be cleaned by simply removing the filter, flexible hose, belt, and carrying strap from the housing, and inserting (typically threading) watertight plugs (not shown) into the air inlet and air outlet of the housing. The housing can then be fully immersed in water in the course of cleaning the housing, and if desired, can be washed in a conventional dish washing machine.

Various modifications and alterations of this invention will become apparent to those skilled in the art without departing from the scope and spirit of this invention.

What is claimed is:

1. A housing for a powered air purifying respirator blower unit, comprising:

a) first and second major faces which are spaced from each other, and a top wall, side walls, and bottom wall connecting the major faces along their peripheries, the first and second major faces and the top wall, side walls, and bottom wall enclosing therebetween an air chamber;

b) an air inlet and an air outlet which are in communication with the air chamber, the air outlet being proximate the top wall;

c) a support base which is proximate the air outlet and connected to the first major face;

d) a pommel-like strap support member protruding from the support base in a direction away from the second major face, the pommel-like member comprising a lower exterior support surface which is adapted to support a carrying strap thereon, wherein the air outlet opens through the top of the pommel-like member; and e) means for retaining a carrying strap on the pommel-like member.

2. The housing of claim 1 wherein the lower exterior support surface comprises a curved portion.

3. The housing of claim 2 wherein the curved portion has a radius of curvature which is larger than half the width of the air outlet.

4. The housing of claim 3 wherein the central axis about which the radius of curvature of the curved portion is defined extends perpendicularly away from the support base and away from the second major face at an angle of between about 105 and about 120 degrees relative to the plane in which the first major face lies.

5. The housing of claim 4 wherein the angle is about 110 degrees.

6. The housing of claim 1 wherein the support base is integral with the first major face and is inclined such that it slopes toward the second major face and the top wall.

7. The housing of claim 1 wherein said retaining means comprises a front retaining wall attached to the end of the pommel-like member distal to the support base.

8. The housing of claim 1 wherein the carrying strap slidably supports the pommel-like member.

9. A powered air purifying respirator comprising:

a) a blower unit housing and a motor-driven blower disposed in the housing, the housing comprising:

i) first and second major faces which are spaced from each other, and a top wall, side walls, and bottom wall connecting the major faces along their peripheries, the first and second major faces and the top wall, side walls, and bottom wall enclosing therebetween an air chamber;

ii) an air inlet and an air outlet which are in communication with the air chamber, the air outlet being proximate the top wall;

iii) a support base which is proximate the air outlet and connected to the first major face;

iv) a pommel-like strap support member protruding from the support base in a direction away from the second major face, the pommel-like member comprising a lower exterior support surface which is adapted to support a carrying strap thereon, wherein the air outlet opens through the top of the pommel-like member; and v) means for retaining a carrying strap on the pommel-like member;

b) a facepiece defining a space adapted to cover the mouth and nose of a wearer and having an inlet and outlet for air;

c) means for filtering one or more unwanted components from external air drawn into the housing by operation of the blower; and d) means for transporting air from the air outlet of the housing to the inlet of the facepiece.

10. The respirator of claim 9 wherein the lower exterior support surface comprises a curved portion.

11. The respirator of claim 10 wherein the curved portion has a radius of curvature which is larger than half the width of the air outlet.

12. The respirator of claim 11 wherein the central axis about which the radius of curvature of the curved portion is defined extends perpendicularly away from the support base and away from the second major face at an angle of between about 105 and about 120 degrees relative to the plane in which the first major face lies.

13. The respirator of claim 12 wherein the angle is about 110 degrees.

14. The respirator of claim 9 wherein the support base is integral with the first major face and is inclined such that it slopes toward the second major face and the top wall.

15. The respirator of claim 9 wherein said retaining means comprises a front retaining wall attached to the end of the pommel-like member distal to the support base.

16. The respirator of claim 9 wherein the carrying strap slidably supports the pommel-like member.

* * * * *